US009592987B2

(12) United States Patent
Ehrentraut et al.

(10) Patent No.: US 9,592,987 B2
(45) Date of Patent: Mar. 14, 2017

(54) STRIP DEFLECTION DEVICE

(71) Applicant: PRIMETALS TECHNOLOGIES AUSTRIA GMBH, Linz (AT)

(72) Inventors: Gottfried Ehrentraut, Linz (AT); Guenter Karner, Ybbs an der Donau (AT)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 280 days.

(21) Appl. No.: 14/404,702

(22) PCT Filed: Jun. 12, 2013

(86) PCT No.: PCT/EP2013/062097

§ 371 (c)(1),
(2) Date: Dec. 1, 2014

(87) PCT Pub. No.: WO2013/189792

PCT Pub. Date: Dec. 27, 2013

(65) Prior Publication Data

US 2015/0122865 A1 May 7, 2015

(30) Foreign Application Priority Data

Jun. 19, 2012 (EP) ..... 12172560

(51) Int. Cl.
*B65H 23/32* (2006.01)
*B21C 47/34* (2006.01)
*B65H 27/00* (2006.01)

(52) U.S. Cl.
CPC ..... *B65H 23/32* (2013.01); *B21C 47/34* (2013.01); *B65H 27/00* (2013.01);
(Continued)

(58) Field of Classification Search
CPC ..... B65H 20/02; B65H 27/00; B65H 23/32; B65H 2404/54; B65H 2301/3423; B65H 2701/173; B21C 47/34
(Continued)

(56) References Cited

U.S. PATENT DOCUMENTS 7,213,785 B2 5/2007 Richert et al.

FOREIGN PATENT DOCUMENTS

DE 10 90 621 B 10/1960
DE 29 48 290 A1 6/1981
(Continued)

OTHER PUBLICATIONS

Chinese Office Action, dated Oct. 27, 2015, issued in corresponding Chinese Patent Application No. 201380032383.4. Including English translation. Total 22 pages.
(Continued)

*Primary Examiner* — William E Dondero
(74) *Attorney, Agent, or Firm* — Ostrolenk Faber LLP

(57) ABSTRACT

A strip deflection device (1) for deflecting a strip (2), in particular a metal strip, at an angle: at least one deflecting cylinder (3) around which the strip (2) can be deflected by a deflection angle (7) while maintaining strip tension. The angle is defined by the inlet direction (14) and the outlet direction (15) of the strip (2). Rollers (20) on the circumference of the deflection cylinder (3), form bearing faces of equal height for the strip (2) along a wrap around the cylinder. The deflection cylinder (3) can be adjusted between a first (31) and a second operating position (32) preferably perpendicular by an adjusting device (16). Each operating position (31, 32) is associated with a respective arrangement (10, 11) of the rollers (20) and the rollers in that arrangement (10, 11) are oriented in a direction that corresponds to the wrap around the cylinder.

20 Claims, 8 Drawing Sheets

(52) U.S. Cl.
CPC .. *B65H 2301/3423* (2013.01); *B65H 2404/54* (2013.01); *B65H 2701/173* (2013.01)

(58) Field of Classification Search
USPC ..... 242/615.21
See application file for complete search history.

(56) References Cited

FOREIGN PATENT DOCUMENTS

| | | |
|---|---|---|
| JP | 55-80641 | 6/1980 |
| JP | S57-180550 | 11/1982 |
| JP | 58-135049 | 8/1983 |
| JP | 60-148623 | 8/1985 |
| JP | 2001-302048 | 10/2001 |
| KR | 100 869 266 B1 | 11/2008 |

OTHER PUBLICATIONS

International Search Report dated Sep. 25, 2013 issued in corresponding International patent application No. PCT/EP2013/062097.
Written Opinion dated Sep. 25, 2013 issued in corresponding International patent application No. PCT/EP2013/062097.

Operating position 1

Operating position 1

STRIP DEFLECTION DEVICE

CROSS-REFERENCE TO RELATED APPLICATIONS

The present application is a 35 U.S.C. §§371 National Phase conversion of PCT/EP2013/062097, filed Jun. 12, 2013, which claims priority of European Patent Application No. 12172560.0, filed Jun. 19, 2012, the contents of which are incorporated by reference herein. The PCT International Application was published in the German language.

TECHNICAL FIELD

The present invention relates to a strip deflection device for deflecting strips, in particular metal strips, at an angle. The strip deflection device comprises a deflection cylinder around which the strip can be deflected while maintaining the strip tension, wherein the strip is supported by means of rolling elements which are arranged on the deflection cylinder along a helical wrap surface and form bearing faces of equal height.

PRIOR ART

In the industrial treatment of strips the individual processing stations are frequently accommodated in different production halls, which are arranged at an angle or laterally transposed to one another. The direction of the strip run in a process train then has to be altered for production technology reasons, and often the top and bottom of a strip are inverted.

Various devices are known for deflecting strips. For example, DE 29 482 90 A1 describes guiding a strip over a deflection cylinder which is provided with rollers. A spiral-shaped deflection is known from JP 55 080641 A.

An angular deflection and/or reorientation of the strip surfaces, in which the inside or outside of a strip can optionally be fed to a subsequent process step as a "go side" is also often required in the case of process trains for metal strips.

In the metal industry various apparatuses are known for angular deflection, for example specially designed deflection stations. To reorient the surfaces of a strip it is known to alternately pay out the strip from the top or the bottom in the infeed section of the installation. Another possibility is to alternately wind up from the top or the bottom in the outfeed section of the installation. A third possibility may also comprise winding a strip round a special installation. All these measures are associated with considerable technical effort.

PRESENTATION OF THE INVENTION

The object of the invention is to specify a strip deflection device and a method for deflecting the strip which requires less technical effort.

According to a basic principle of the invention, rollers with a different angulation are used on the circumferential side of a deflection cylinder: on one half-shell the rollers are arranged on the left hand, and on the other on the right hand. Depending on the direction of the intake strip, the rollers of one or the other half-shell act as bearing faces for the strip. The deflection device is thus characterized in that the deflection cylinder can be adjusted between a first operating position and a second operating position, wherein each operating position is respectively assigned an arrangement of the rollers, and wherein the rollers of an arrangement are oriented with an angulation that corresponds to the helical wrap. Depending on production engineering circumstances a strip, which comes alternatively from two infeed directions oriented opposite one another, can thereby easily be deflected in each case by a deflection angle, for example by 90°.

BRIEF DESCRIPTION OF THE DRAWINGS

To further explain the invention, reference is made in the following part of the description to drawings, from which further advantageous embodiments, details and developments of the invention can be taken on the basis of non-restrictive exemplary embodiments.

In the drawings.

EMBODIMENTS OF THE INVENTION

Figure 1:
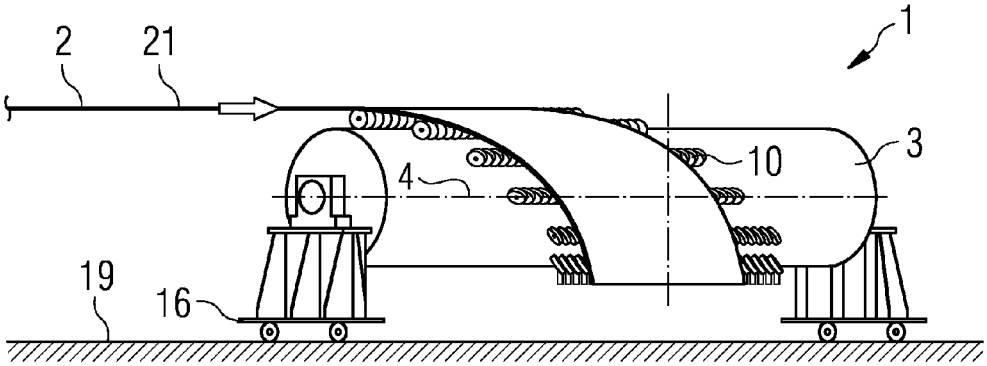
FIG. 1 shows a side view of a first exemplary embodiment of the inventive strip deflection device.

FIG. 1 shows a schematic side view of an exemplary embodiment of a strip deflection device 1. It essentially comprises a deflection cylinder 3, having a circumferential face on which rows of rolling elements are arranged which are embodied as directional rollers 20. In FIG. 1 the strip 2 is initially fed in from left to right, encounters the deflection cylinder 3 at the top and leaves it at the bottom thereof. The cylinder 3 is torsionally rigid on a frame, but can be pivoted by means of an adjustment device 16 about a vertical axis 5 (see FIG. 6 and FIG. 8) between two operating positions 31, 32 (FIG. 4), wherein in each of these operating positions different arrangements 10, 11 of rollers 20 are used on the circumferential side of the deflection cylinder 3. A fuller explanation of the rollers 20 with a right-hand arrangement 10 and a left-hand arrangement 11 is given in FIGS. 9 and 10.

Figure 2:
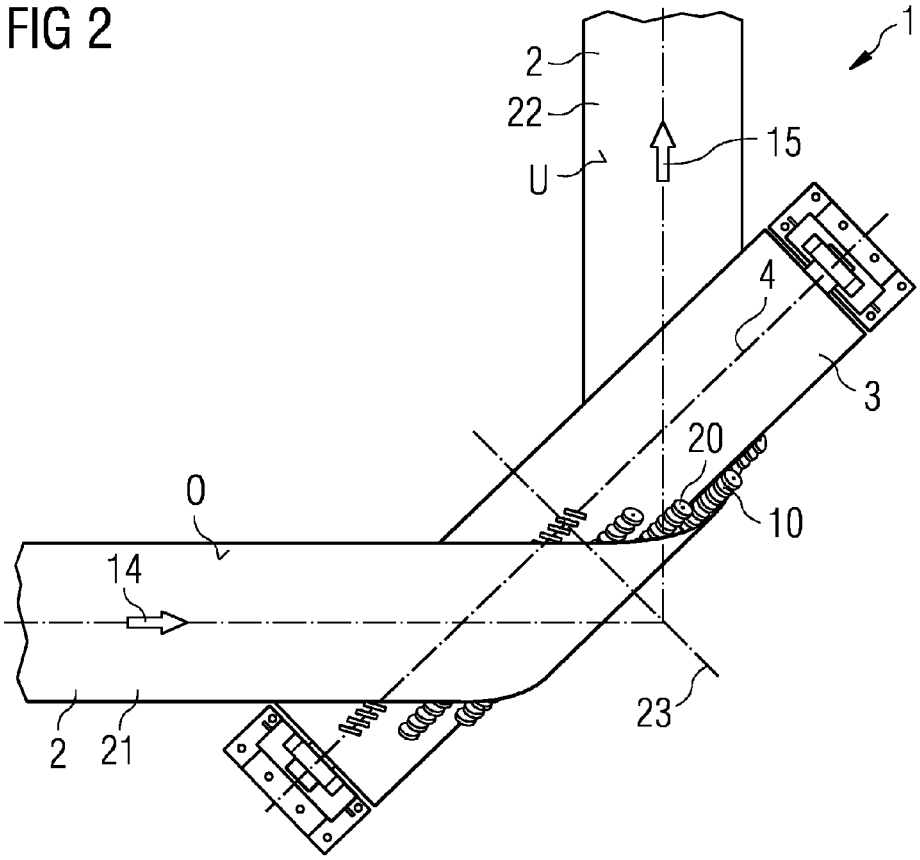
FIG. 2 shows a plan view of the strip deflection device according to FIG. 1.

FIG. 2 shows the scenario in a plan view. The strip 2 is again fed in from the left in the direction of the arrow 14 and leaves the strip deflection device 1 in the direction of the upward-pointing arrow 15. The deflection angle 7 is 90°. The wrap of the deflection cylinder 3 in FIG. 1 and FIG. 2 is clockwise in the context of the right-hand rule, i.e. in the shape of a right-hand cylindrical spiral. The top "O" of the infeed strand 21 is inverted after it leaves the strip deflection device 1, so that in the plan view in FIG. 2 the bottom "U" of the strip 2 can be seen in the outfeed strand 22. With the device illustrated in FIG. 1 and FIG. 2 it is thus possible to alter the orientation of the strip 2 so that after leaving the strip deflection device 1 the strip 2 fed in from the left is fed into the next process step with its top downward and at right angles in respect of the infeed direction 14.

Figure 3:
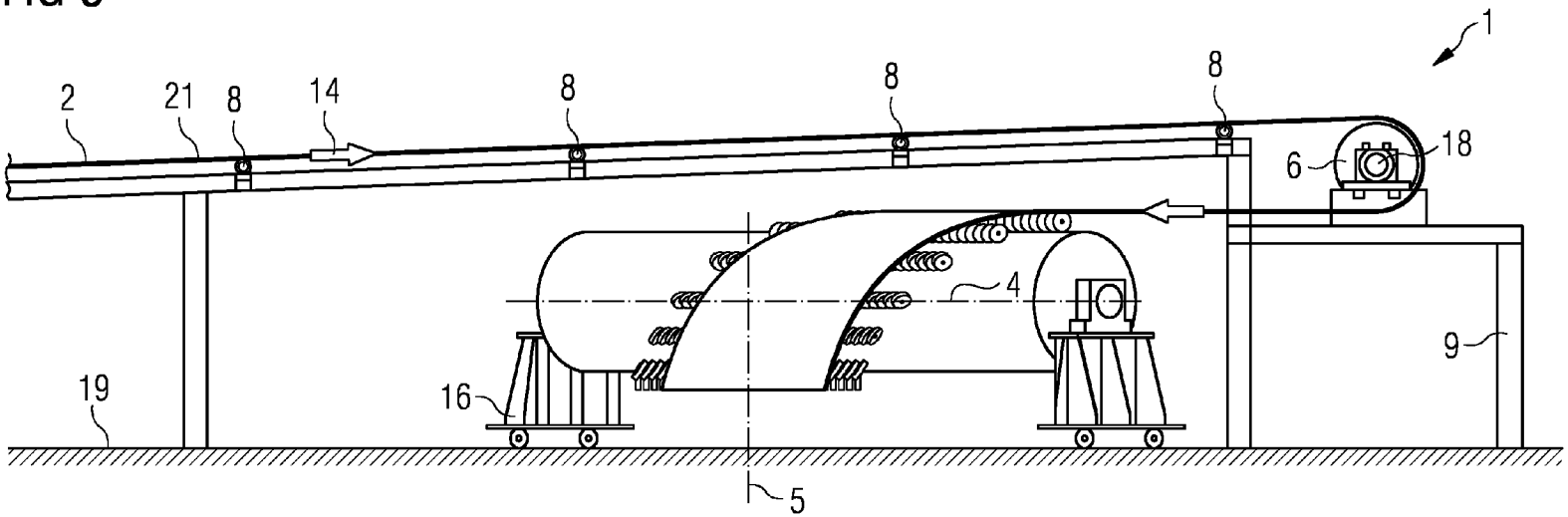
FIG. 3 shows a side view of a second exemplary embodiment of the inventive strip deflection device.

As already stated in the introduction, the infeed direction 14 and the desired outfeed direction 15 are determined by the topology of the individual processing stations in a production hall. The object can consist in diverting, at an angle, a strip 2 fed in in accordance with an infeed direction 14 and simultaneously also effecting a reorientation of the strip 2, in other words inverting the top O of the strip and the bottom U of the strip. Another object can consist in diverting, at an angle, a strip 2 fed in in accordance with the infeed direction 14, without simultaneously effecting a reorientation of the strip 2, in other words the infeed-side strip surface also remains as the outfeed-side strip surface. In the latter case another roller, the deflection roller 6 illustrated in FIG. 3, is a component of the strip deflection device 1. The object can however also consist in deflecting upward a strip 2 fed in contrary to the strip running direction 14, e.g. by 90° (now in a mathematically positive sense) in FIG. 2.

Figure 4:
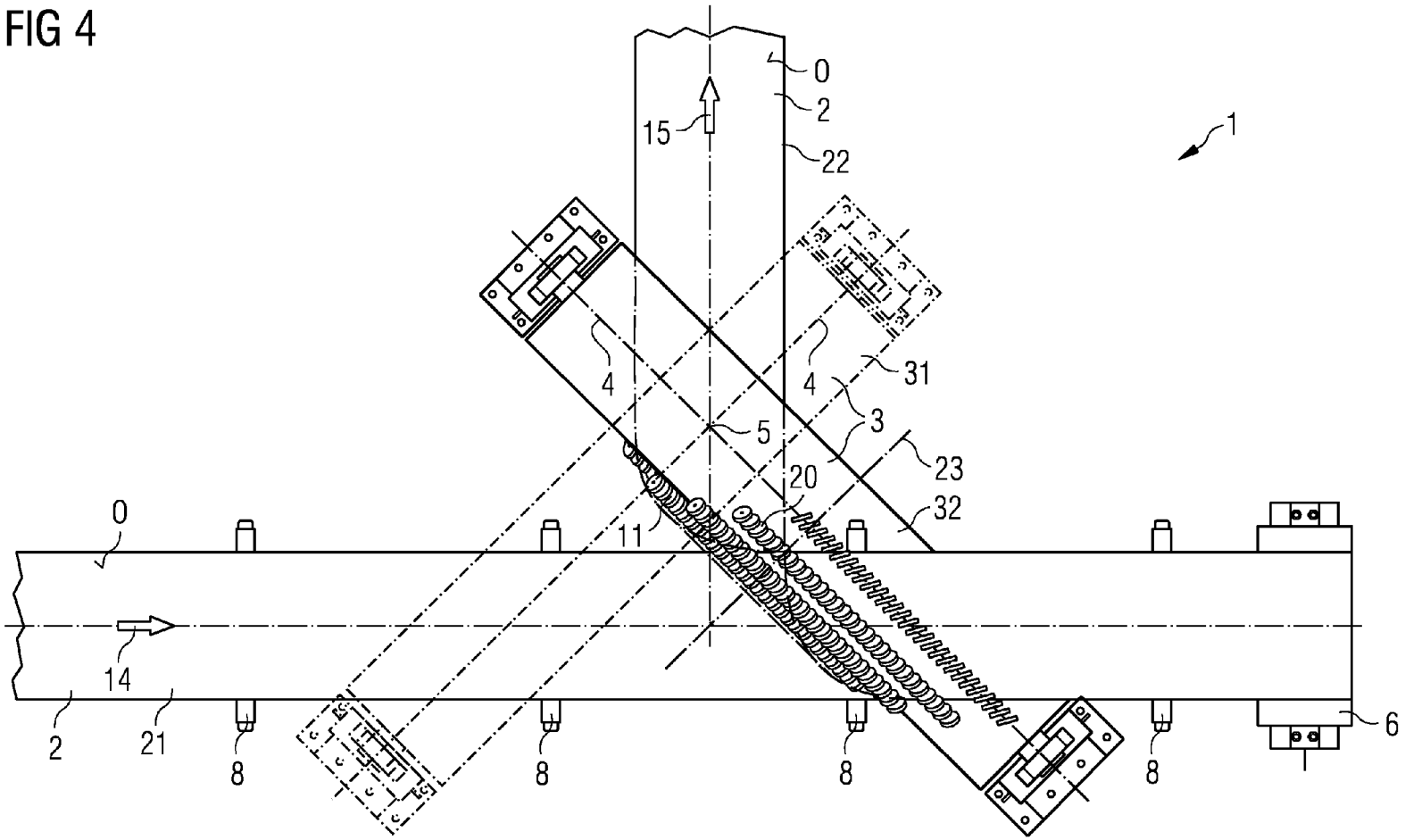
FIG. 4 shows a plan view of the strip deflection device according to FIG. 3.
Figure 5:
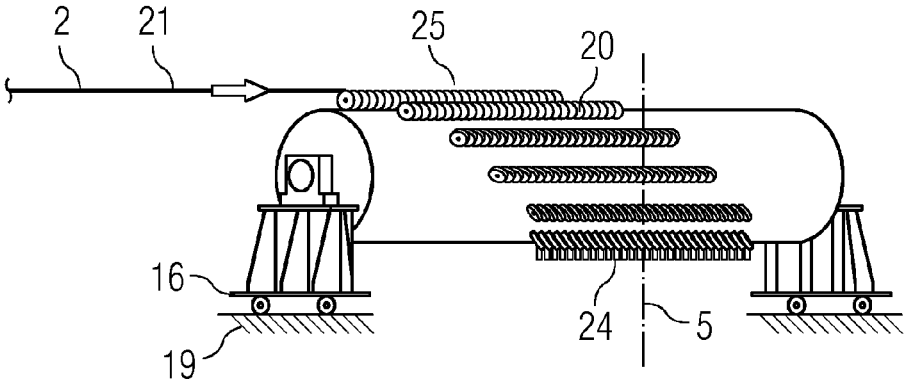
FIGS. 5 to 8 show a comparison between a first operating mode, in which a simple angular strip deflection occurs, and a second operating mode in which an angular strip deflection and simultaneously a dual reorientation of the strip occurs, in which the strip is fed into the first strip deflection device by the top and leaves the second again by the top.
Figure 6:
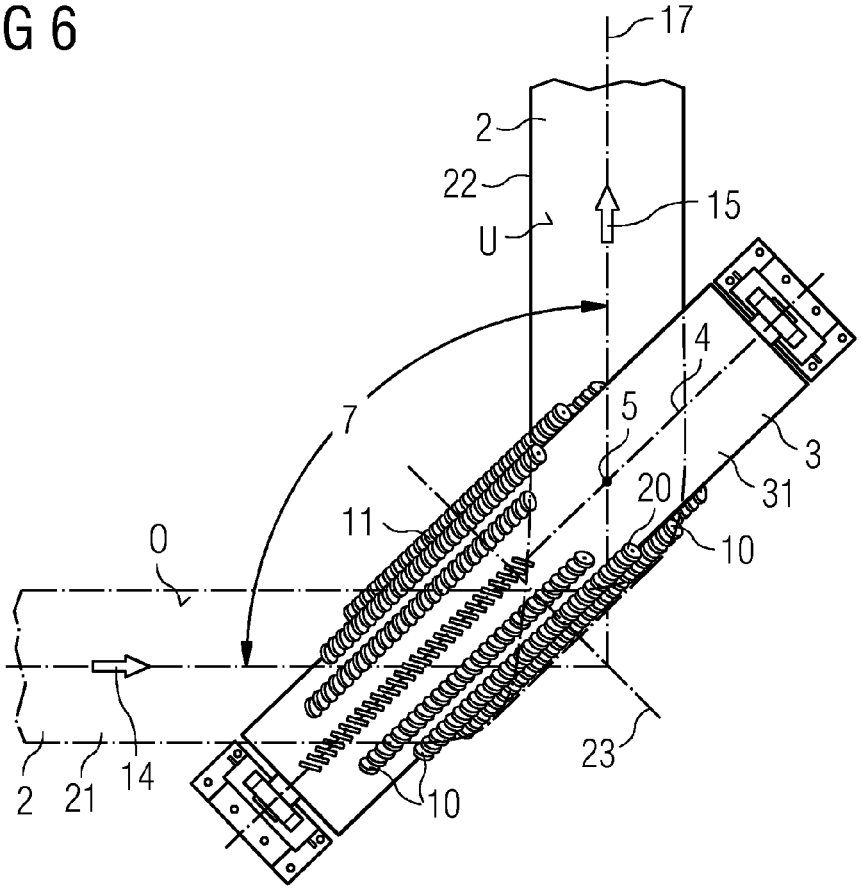
Figure 7:
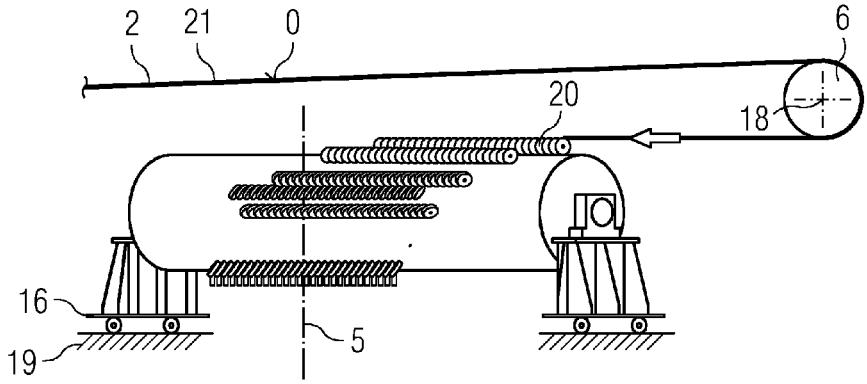
Figure 8:
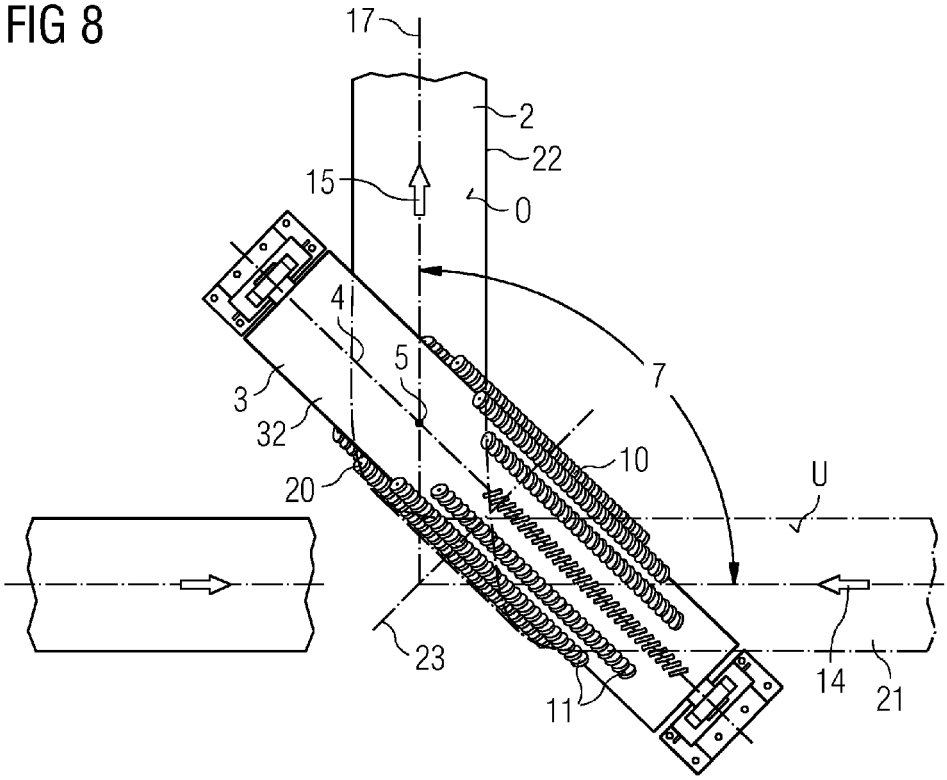

In the next two illustrations in FIG. 3 and FIG. 4 an exemplary embodiment is shown, in which the strip 2 likewise coming from the left should also leave the strip deflection device 1 with the top side "O" uppermost. According to FIG. 3 the strip 2 is thus fed into the strip deflection device 1 supported by support rollers 8 according to the arrow 14, but there initially encounters the deflection roller 6. The axis 18 of said deflection roller 6 can be rotatably mounted in bearings and is attached to a supporting structure 9. It effects a 180° turn of the strip 2. The strip running plane is reduced by the diameter of the deflection roller 6 (depending on the level at which the deflection roller 6 is situated; thanks to an arrangement of several deflection rollers 6 the strip running plane can be varied as desired). In FIG. 3 the strip 2 again encounters a deflection cylinder 3 downstream, which however is now in a different (second) operating position 32 in respect of the illustration in FIG. 2. This second operating position 32 arises from the first operating position 31 (see also FIG. 2) thanks to a horizontal pivoting motion by 90°. The pivoting motion corresponds to the deflection angle 7 (FIG. 6, FIG. 8). The pivot axis 5 of said pivoting motion lies in the intersection between the axis 4 of the deflection cylinder 3 and the central axis 17 of the running strand 22. In said second operating position 32 the strip 2 again wraps around the deflection cylinder 3, but now in a left-hand cylindrical spiral. In contrast to FIG. 2, another group of rollers 20 is also now used, namely roller cassettes with a left-hand orientation 11. Here the rollers 20 are angulated in accordance with a left-hand helical curve.

Since the angulation of the rollers 20 in each roller cassette 10, 11 is oriented in each case in accordance with the direction of rotation of the respective wrap, there are no differences on the wrap face in the speed between deflection cylinder 3 and strip 2, so that scratches and other damage to the surface of the strip 2 are prevented.

The helical wrap of the deflection cylinder 3 in FIG. 4 effects a second reorientation, in other words top and bottom are once again inverted, so that the strip 2 again leaves the strip deflection device 1 on the same side. In FIG. 4 this is embodied in that the top of the strip 2 in the infeed strand 21 is designated by "O" and that in the outfeed strand 22 is also designated by "O".

To switch operating modes the continuous strip is initially separated from the deflection cylinder 3. The deflection cylinder 3 is then pivoted and the strip 2 is re-threaded. Switching the strip deflection device 1 between the first and the second operating position 31, 32 is explained once again below on the basis of a comparison (the strip 2 is shown transparently in FIGS. 5 to 8).

First Operating Position 31 of the Deflection Cylinder 3 (FIG. 5 and FIG. 6):

To deflect the strip 2 fed in from the left by a deflection angle 7 of 90°, the deflection cylinder 3 is in a first operating position 31. Here the first arrangement 10 of the rollers 20 provides bearing faces for the right-hand wrap. The second arrangement 11 of the rollers 20 is on the other half-shell and is not in use.

Second Operating Position 32 of the Deflection Cylinder 3 (FIG. 7 and FIG. 8):

To deflect the strip 2 fed in from the left (see FIG. 7) not only by 90°, but also to feed it to subsequent process steps with the same "go side", the strip 2 is first inverted by a deflection roller 6. The angular deflection is then effected by the deflection cylinder 3. In contrast to the first operating position, the arrangement 11 of the rollers 20 now however forms the bearing faces for a left-handed wrap of the strip 2. The arrangement 10 of the rollers 20 arranged on the opposite half-shell is not in contact with the strip.

The arrangement of the deflection cylinder 3 and the deflection roller 6 is selected such that the strip running plane is the same in both operating positions after leaving the strip deflection device 1.

Switching between the first operating position 31 and the second operating position 32 is effected as already stated in the present example by a carousel 16 which is supported on rollers in a guideway on the floor (foundation) 19 of a production hall. The carousel 16 can be driven by chains or by a gear unit or in another way. By means of the carousel 16 the deflection cylinder 3 can be pivoted back and forth in a horizontal plane by a pivot angle of for example 90°. The pivot axis 5 here runs in the intersection between the axis 4 of the deflection cylinder 3 and the central axis 17 of the outfeed strand 22. This means the axis 17 of the outfeed strand 22 is identical for both operating positions 31 and 32.

Figure 9:
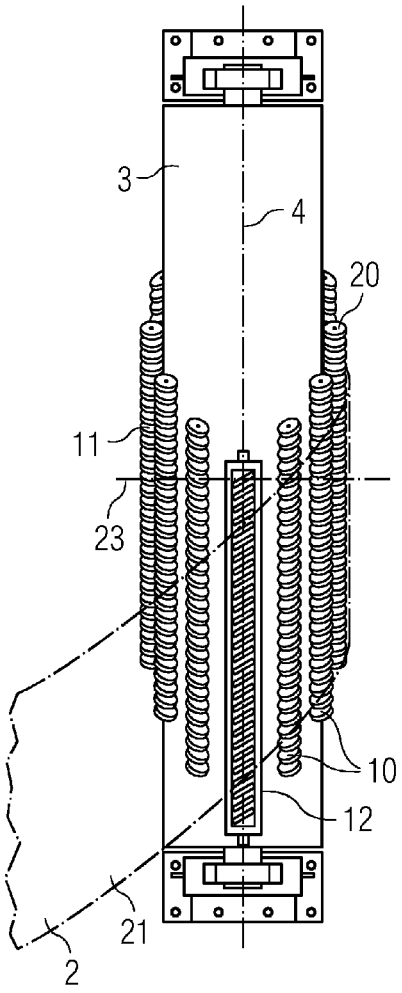
FIG. 9 shows a right-hand wrap of a deflection cylinder.

FIG. 9 shows the plan view of a deflection cylinder 3, which is wrapped by the strip 2 in a right-hand spiral. This corresponds to the first operating position 31 of the deflection cylinder 3. All rollers 20 in contact with the strip must have an orientation corresponding to this right-hand spiral.

Figure 10:
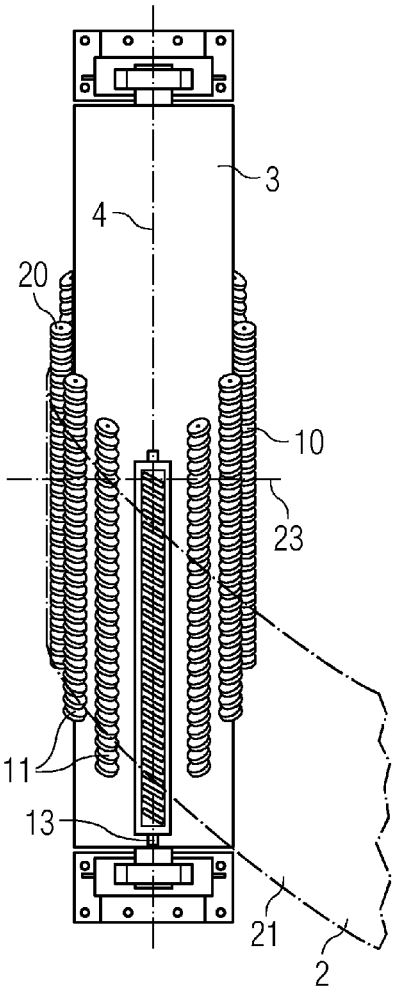
FIG. 10 shows a left-hand wrap of a deflection cylinder.

FIG. 10 shows the plan view of a deflection cylinder 3, which is wrapped by the strip 2 in a left-hand spiral. This corresponds to the second operating position 32 of the deflection cylinder 3. All rollers 20 in contact with the strip must have an orientation corresponding to this left-hand spiral.

For production engineering reasons it is expedient to combine the rollers 20 in common subassemblies. Thus the right-hand rollers 20 are accommodated in right-hand roller cassettes with a right-hand orientation 10, while left-hand rollers 20 are accommodated in left-hand roller cassettes with a left-hand orientation 11.

In each roller cassette 10 the rollers 20 are oriented parallel to one another and in the direction of the right-hand helix. Each roller cassette 10 is assigned an attachment face on the cylinder sleeve face. A roller cassette 10 is attached to the cylinder 3 by screws. This means the roller cassettes 10 can easily be exchanged. The roller cassettes 10 can however also be detachably attached to the cylinder sleeve face in another way.

The same applies for the roller cassettes 11 on which the rollers 20 are oriented in the direction of a left-hand helix.

As is illustrated in FIGS. 9 and 10, the roller cassettes 10 are in contact with the strip 2 only in the case of a right-hand wrap and are free in the case of the left-hand wrap, while the roller cassettes 11 are in contact with the strip 2 only in the case of a left-hand wrap and is free in the case of the right-hand wrap.

However, the wrap of the strip 2 extends from the top vertex 25 of the deflection cylinder 3 ("12 o'clock") to its bottom vertex 24 ("6 o'clock"). Therefore when the operating position is switched from 31 to 32 and vice versa the orientation of the rollers 20 at the vertices 24 and 25 must also be switched. This can be done by undoing the attachment and exchanging the roller cassettes. Another option is to use a rotatable pivot cassette 12 on the top and bottom vertex 24, 25 of the deflection cylinder 3.

Here the rollers 20 are accommodated in a roller cassette 12 which is mounted so as to rotate about its axis of rotation 13. The axis of rotation 13 is parallel to the cylinder axis 4. By rotating the pivot cassette 12 by 180 degrees the orientation of the rollers 20 is switched from right-hand to left-hand or vice versa.

A crucial advantage of the invention is that the machines of the prior art, which are complex in terms of mechanics and control engineering, are no longer required for switching the top and bottom of the strip. In particular, when a coupling of two lines is retrofitted, it is possible to switch the top O of the strip and the bottom U of the strip using simple means.

Arranging the rollers 20 in cassettes has the advantage that the orientation of the rollers can easily be changed by switching the cassettes.

In the vertices 24 and 25 the orientation of the rollers 20 can be changed thanks to the symmetrical structure of the pivot cassette 12 by rotating them about their longitudinal axis 13 by 180°.

Figure 11:
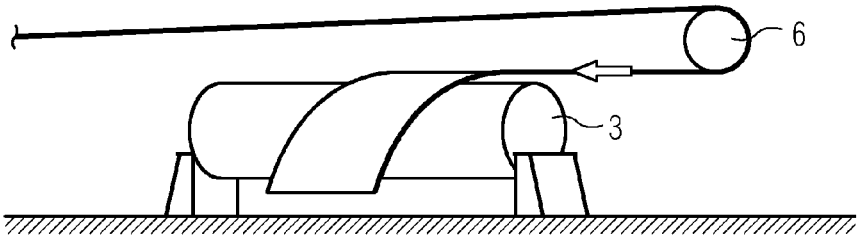
FIG. 11 shows an embodiment of a strip deflection device, wherein the strip is fed by way of a deflection roller which is arranged above a deflection cylinder.
Figure 14:
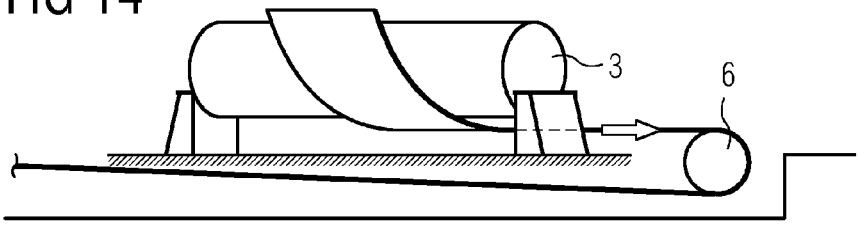
FIG. 14 shows an embodiment of a strip deflection device, wherein the strip initially helically wraps around a deflection cylinder and then runs by way of a deflection roller arranged below the deflection cylinder.

The arrangement of deflection cylinder 3 and deflection roller 6 may differ depending on local circumstances and requirements. FIGS. 11 and 14 show different scenarios by way of example:

FIG. 11 shows an embodiment of a strip deflection device 1, wherein the strip 2 is fed by way of a deflection roller 6 which is arranged above a deflection cylinder 3.

Figure 12:
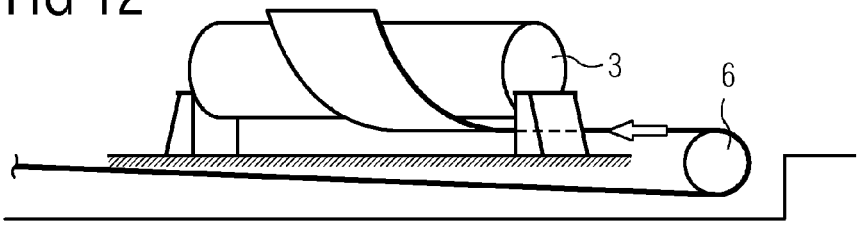
FIG. 12 shows an embodiment of a strip deflection device, wherein the strip is fed by way of a deflection roller which is arranged below a deflection cylinder.

FIG. 12 shows a scenario in which the strip 2 is fed by way of a deflection roller 6 which is arranged below a deflection cylinder 3.

Figure 13:
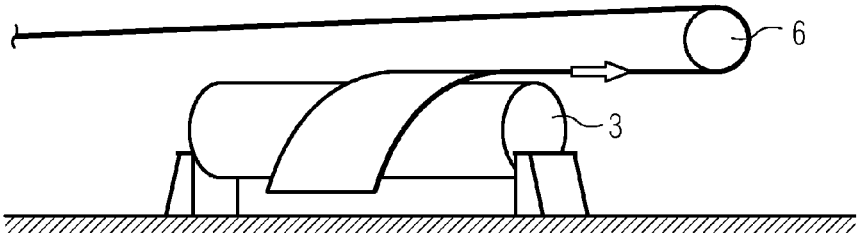
FIG. 13 shows an embodiment of a strip deflection device, wherein the strip initially helically wraps around a deflection cylinder and then runs by way of a deflection roller arranged above the deflection cylinder.

FIG. 13 shows an embodiment of a strip deflection device 1, wherein the strip 2 initially helically wraps around a deflection cylinder 3 and then runs by way of a deflection roller 6 arranged above the deflection cylinder 3.

In FIG. 14 the strip 2 initially helically wraps around a deflection cylinder 3 and then runs by way of a deflection roller 6 arranged below the deflection cylinder 3.

Figure 15:
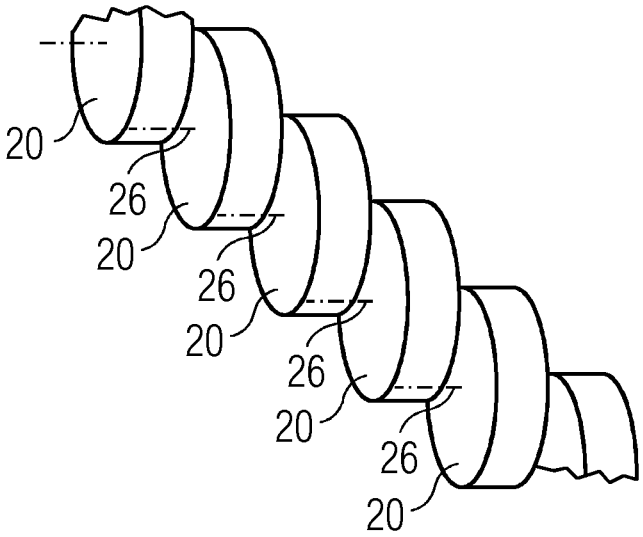
FIG. 15 shows a dissected detailed drawing in which rollers oriented parallel to one another are illustrated on the deflection cylinder.

FIG. 15 shows a region of the deflection cylinder 3 with a view of an array-like arrangement of rollers 20. The rollers 20 are disk-shaped. Their end faces are oriented parallel to one another. Each roller 20 is mounted so as to rotate about axis 26.

Although the invention has been illustrated and described in greater detail on the basis of the preferred exemplary embodiments explained above, the invention is not limited by the disclosed examples and other variations can be derived herefrom by the person skilled in the art without departing from the scope of protection of the invention.

Thus as described, the strip 2 runs from above via the deflection roller 6 and from above via the deflection cylinder 3. In a different arrangement of deflection roller 6 and deflection cylinder 3 it is also possible to guide the strip 2 from below via the deflection roller 6 and from below via the deflection cylinder 3 (FIG. 12) or to first guide it via the deflection cylinder 3 and then via the deflection roller 6 (FIG. 13) (starting from bottom to top or from top to bottom).

Thus for example the deflection cylinder 3 arranged as torsionally rigid in the above example can also be rotatably mounted.

The rollers 20 can be designed differently, for example have a cylindrical running surface, or else can be shaped like a barrel.

The deflection angle 7 is of course not restricted to 90°, but can be a different value.

Differently shaped roller bars can also be used instead of the roller cassettes 10, 11 or 12. Apart from in the vertices 24 and 25 the supports of the rollers 20 can also be fixedly attached to the circumference of the deflection cylinder 3.

The mounting of the individual rollers 20 should essentially be free-moving.

Although the axes of the rollers 20 lie parallel on a roller cassette, they are offset.

SUMMARY OF THE REFERENCE CHARACTERS USED

1 Strip deflection device
2 Strip
3 Deflection cylinder (helical turning roll)
4 Axis of the deflection cylinder 3
5 Pivot axis
6 Deflection roller
7 Deflection angle
8 Support roller
9 Supporting structure
10 Roller cassette with right-hand orientation
11 Roller cassette with left-hand orientation
12 Pivot cassette
13 Axis of rotation of the pivot cassette 12 in the vertices 24 and 25
14 Infeed direction
15 Outfeed direction
16 Adjusting device, carousel
17 Center axis of the running strip
18 Axis of the deflection roller 6
19 Floor, foundation
20 Rollers
21 Infeed strand
22 Outfeed strand
23 Line of symmetry of the deflection cylinder 3
24 Vertex
25 Vertex
26 Axis of a roller 20
31 First operating position
32 Second operating position O Top of strip
U Bottom of strip

The invention claimed is:

1. A strip deflection device for deflecting a strip, at an angle, the device comprising:

a deflection cylinder around which the strip can be deflected at the angle while maintaining a strip tension, the angle is defined by an angle between the infeed direction and the outfeed direction of the strip to and from the cylinder;

rollers provided at and each oriented in a circumferential direction of the deflection cylinder form support faces for the strip along a helical wrap of the strip around the cylinder;

the deflection cylinder is adjustable between a first operating position and at least one second operating position, wherein each of the first and second operating positions is associated with a respective arrangement of the rollers, and wherein the rollers of each respective arrangement are oriented at a respective angulation that corresponds to a respective helical wrap.

2. The device as claimed in claim 1, further comprising:

the rollers are arranged on a right hand side of the cylinder in a first arrangement in a circumferential direction of the deflection cylinder and on a left hand side of the cylinder in a second arrangement in the circumferential direction of the deflection cylinder.

3. The device as claimed in claim 2, further comprising:

the deflection cylinder is pivotable about a pivot axis across the axis of the cylinder between the operating positions thereof;

the rollers are arranged in groups thereof, each roller has an axis of rotation extending parallel to a longitudinal axis of the deflection cylinder in the vertices of the deflection cylinder, and the rollers are oriented to lie parallel to one another, and by rotational adjustment of the cylinder about the axis of rotation the of the cylinder, the orientation of the rollers can be switched between a first orientation on the right hand and a second orientation on the left hand.

4. The device as claimed in claim 3, further comprising respective roller cassettes in which each group of the rollers are arranged, and each roller cassette is arranged in an axial direction on a circumferential side of the deflection cylinder.

5. The device as claimed in claim 4, further comprising the deflection cylinder having vertices and the orientation of the rollers can be switched in the vertices of the deflection cylinder by exchanging the roller cassettes.

6. The device as claimed in claim 5, further comprising the cassettes of the rollers configured and operable such that the orientations of the cassettes relative to the vertices of the cylinder are switched by exchange of or rotation of selected roller cassettes on the cylinder.

7. The device as claimed in claim 4, further comprising attachment surfaces on the deflection cylinder configured to receive the roller cassettes.

8. The device as claimed in claim 4, further comprising a longitudinal extension of each roller cassette at both ends of each cassette overhangs a strip that is wrapping the deflection cylinder.

9. The device as claimed in claim 4, further comprising a detachable connection between each roller cassette and the deflection cylinder.

10. The device as claimed in claim 4, further comprising each roller cassette is configured to be attached to the deflection cylinder in selected orientations rotated by 180° about a longitudinal axis of the cassette.

11. The device as claimed in claim 3, further comprising an adjusting device configured and operable for adjusting the deflection cylinder between the first and second operating positions.

12. The device as claimed in claim 1, further comprising the deflection cylinder is pivotable about a pivot axis across the axis of the cylinder between the operating positions thereof.

13. The device as claimed in claim 12, wherein the pivot axis of the cylinder is arranged vertically.

14. The device as claimed in claim 12, wherein the deflection cylinder is pivotable about a pivot angle of up to 90°.

15. The device as claimed in claim 1, further comprising a deflection roller rotatably mounted about an axis thereof and the deflection roller positioned upstream of the deflection cylinder along a path of the strip toward the deflection cylinder.

16. The device as claimed in claim 15, further comprising a supporting structure on which the deflection roller is arranged and the supporting structure is configured to position a level of the deflection rollers higher than a level of the deflection cylinder.

17. The device as claimed in claim 1, wherein the support faces of the rollers are of equal height.

18. The device as claimed in claim 1, further comprising a cylinder adjusting device configured and operable for adjusting the deflection cylinder between the first and second operating positions.

19. The device as claimed in claim 1, wherein the strip is a metal strip.

20. A method for deflecting strips at an angle, by operation of a strip deflection device as claimed in claim 4 comprising the following steps:

providing a strip threaded on the strip deflection device, and the deflection cylinder is situated in a first operating position in the deflection device;

unthreading the strip from the strip deflection device;

changing the operating position of the deflection cylinder;

reorienting the rollers at the vertices of the deflection cylinder by switching the roller cassettes or by rotating the cassettes;

feeding the strip from a second infeed direction and deflecting the strip by positioning the deflection cylinder situated in a second operating position.

* * * * *